US005553861A

United States Patent [19]

Pan

[11] Patent Number: 5,553,861

[45] Date of Patent: Sep. 10, 1996

[54] AUTOMATIC COUNTING APPARATUS FOR A DART GAME WITH HANDICAP FEATURE

[76] Inventor: Francis Pan, No. 7, Tatun 15th St., Taichung, Taiwan

[21] Appl. No.: 494,173

[22] Filed: Jun. 23, 1995

[51] Int. Cl.[6] ..... F41J 5/20

[52] U.S. Cl. ..... 273/371

[58] Field of Search ..... 273/376, 371, 273/373, 374

[56] References Cited

U.S. PATENT DOCUMENTS 4,824,121 4/1989 Beall et al. ..... 273/376
5,193,817 3/1993 Pan ..... 273/376

FOREIGN PATENT DOCUMENTS 2161629 1/1986 United Kingdom .
9409337 4/1994 WIPO .

*Primary Examiner*—Jessica J. Harrison
*Assistant Examiner*—Michael O'Neill
*Attorney, Agent, or Firm*—Hedman, Gibson & Costigan, P.C.

[57] ABSTRACT

An automatic counting apparatus for a dart game which includes darts and a dart board, includes a main control circuit, a conventional dart sensing circuit connected to the main control circuit for sensing a throw of one of the darts onto the dart board and transmitting a corresponding thrown information to the main control circuit, a key set connected to the main control circuit for setting a plurality of inputs to the main control circuit, a plurality of displays for displaying the inputs already set by the key set. The plurality of inputs includes a game mode input, a total number of players input, a common object score input for all players, and a handicap input selectively applied on any one of the players.

2 Claims, 4 Drawing Sheets

AUTOMATIC COUNTING APPARATUS FOR A DART GAME WITH HANDICAP FEATURE

BACKGROUND OF THE INVENTION

1. Field of the Invention

The present invention relates to an automatic counting apparatus for a dart game, especially one which is allowed to set a corresponding handicap for each player, therefore, players with different levels may play on an equal basis in a dart game.

2. Description of the Prior Art

A dart game as disclosed in the U.S. Pat. No. 5,193,817 belongs to the inventor of the present invention. The U.S. Pat. No. 5,193,817 discloses a dart game which includes a dart and a dart board. The dart board includes a base plate and a target frame fixed to the base plate to define a hollow space therebetween. The target frame has a target portion including concentric annular ribs and angularly spaced radial ribs which intersect the annular ribs to form a plurality of spaced scoring areas of different score values. An innermost one of the annular ribs forms a central circular scoring area which defines a bull's-eye section. The target frame further has a plurality of target plates of different shapes corresponding with and respectively disposed in the scoring areas, mounted between the ribs, and shiftable toward the base plate. The dart board further includes an automatic scoring register. The automatic scoring register includes a flat panel mounted in the hollow space and attached to the base plate. The flat panel has a plurality of touch-activated switches provided thereon and arranged in accordance with the target plates. The dart board includes a circuit means mounted in the hollow space and electrically connected to the touch-activated switches and a display unit mounted on the target frame which is electrically connected to the circuit means. A particular one of the target plates is urged to impact one of the touch-activated switches so as to cause the circuit means to control the display unit to show a score which corresponds to the particular one of the target plates when the dart strikes the particular one of the target plates. This dart game works well in a normal competition. However, it can not provide a handicap setting function for players with different levels to play in a dart game.

SUMMARY OF THE INVENTION

The primary objective of the present invention is to provide an automatic counting apparatus for a dart game to thus allow the players to set some inputs including a game mode input, a total player's number input, a common object score input for all players, and a handicap input selectively applied on any one of the players.

In accordance with one aspect of the invention, there is provided an automatic counting apparatus for a dart game which includes darts and a dart board. The automatic counting apparatus includes a main control circuit, a conventional dart sensing circuit connected to the main control circuit for sensing a throw of one of the darts onto the dart board and transmitting a corresponding thrown information to the main control circuit, a key set connected to the main control circuit for setting a plurality of inputs to the main control circuit, a plurality of displays for displaying the inputs already set by the key set. The main control circuit comprises a preprogrammed microcomputer, a read-only memory for storing a firmware, an oscillator connected to the microcomputer, two data buffers and two encoder/decoder circuits connected to the microcomputer for communicating with the dart sensing circuit, the key set and the displays via two buses. The plurality of inputs includes a game mode input, a total player's number input, a common object score input for all players, and a handicap input selectively applied on any one of the players.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
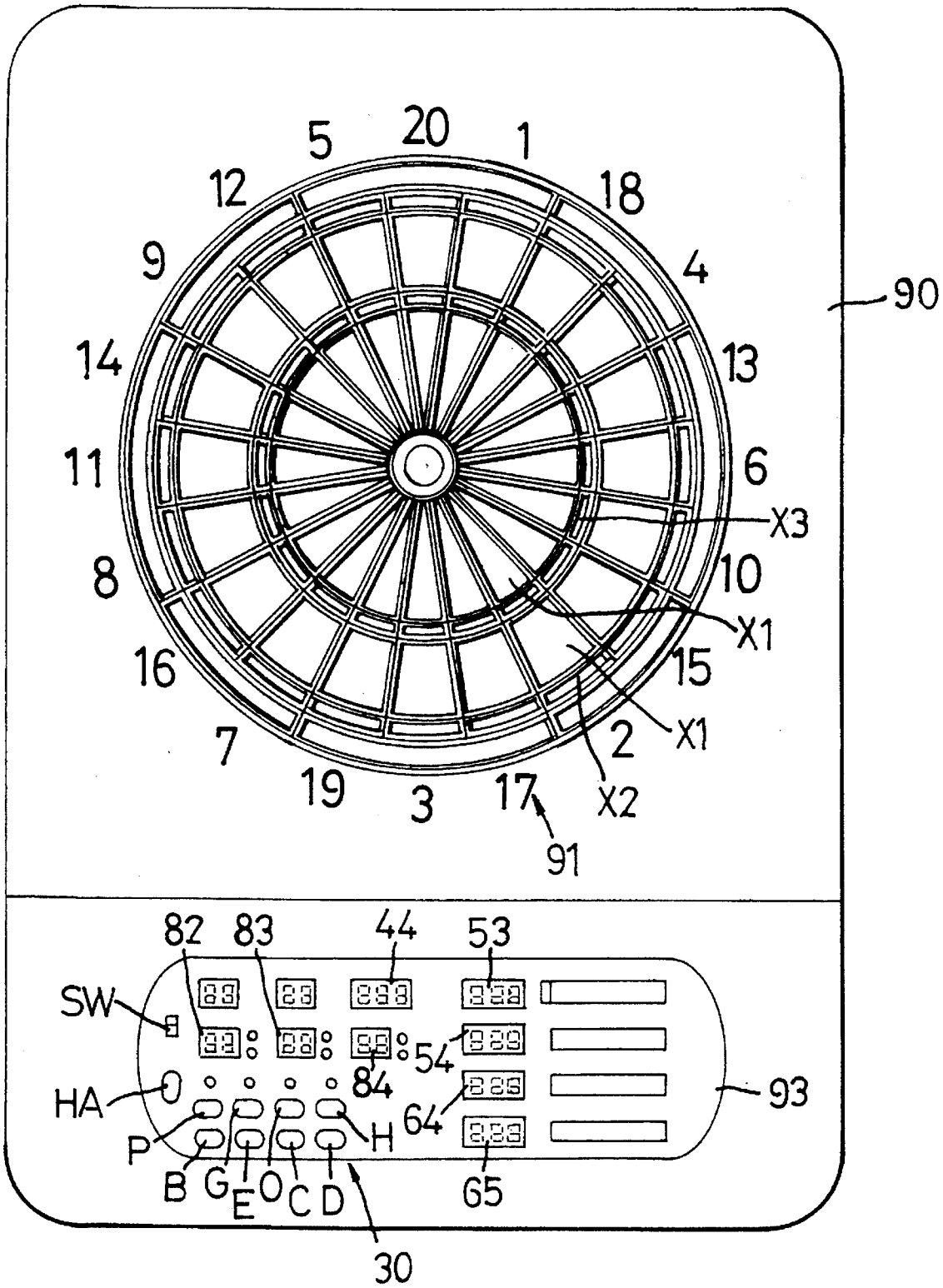
FIG. 1 is a schematic view of a dart game used in the present invention.

Referring to the drawings, and initially to FIG. 1, a dart game comprises a dart board 90, a control panel 93 connected to a low edge of the dart board 90, and a dart (not shown). Since the present invention is considering an automatic counting apparatus of a dart game, therefore, the description of the dart is omitted herein. A plurality of digital lights 91 are formed in substantially a circular manner on the dart board 90 for each to respectively indicate a score when a sector corresponding thereto is hit by the dart. A first display 53, a second display 54, a third display 64, and a fourth display 65 are arranged in a top-down manner on the control panel 93 for respectively indicating a corresponding score of different players. A total score display 44 is formed on the control panel 93 for indicating the total score of the users. Three multiplication factor display 82, 83, and 84 are arranged in alignment with each other in a horizontal manner for cooperating with the digital lights 91 for respectively indicating a multiplication factor such as multiplied by one, two, and three. A power switch SW is mounted on the control panel 93 substantially near one side thereof for controlling power supply to the control panel 93. A key set 30 including a plurality of keys is mounted on a lower portion of the control panel 93 and each key has a specific function. A handicap key HA is used for setting handicap for any specific player. A player setting key P for setting the number of total players to play in this game. A bounce key B allowing selection of "bounce out" dart. A game mode setting key G for setting this game to one of a plurality of games modes. An eliminate key E for reducing a score which has been just added to the scoring when a thrown dart fails to stick on the dart board 90. An option key O for setting an object score, a clear key C for clearing/setting the scores already stored in a memory of the counting apparatus, a hold key H, and a double key D are also formed on the control panel 93. The key set 30 as mentioned above can be used for setting the game mode, the number of total players (in this embodiment the maximum number is four), the object score, the handicap, and other related functions. Once the number of the total players and the object score has been set, the players (assumed there are four players) can start to play the dart game in a sequence, and the scoring of each player will be shown on a corresponding one of the displays 53, 54, 64, and 65 via a calculation and controlling by a control circuit installed in the control panel 93.

It should be noted that an object score has been set before the players start playing the dart game. For players with different skill levels, a handicap can be set by operating the player key P and the handicap key HA for decreasing the object score of a specific player thus achieving the handicap purpose. In addition to the handicap function, the dart board 90 can be defined with multiplication area in each sector such as the X1, X2, and X3 area each respectively represents a multiplication area, for example, multiplied by 1, 2, and 3 respectively.

Figure 2:
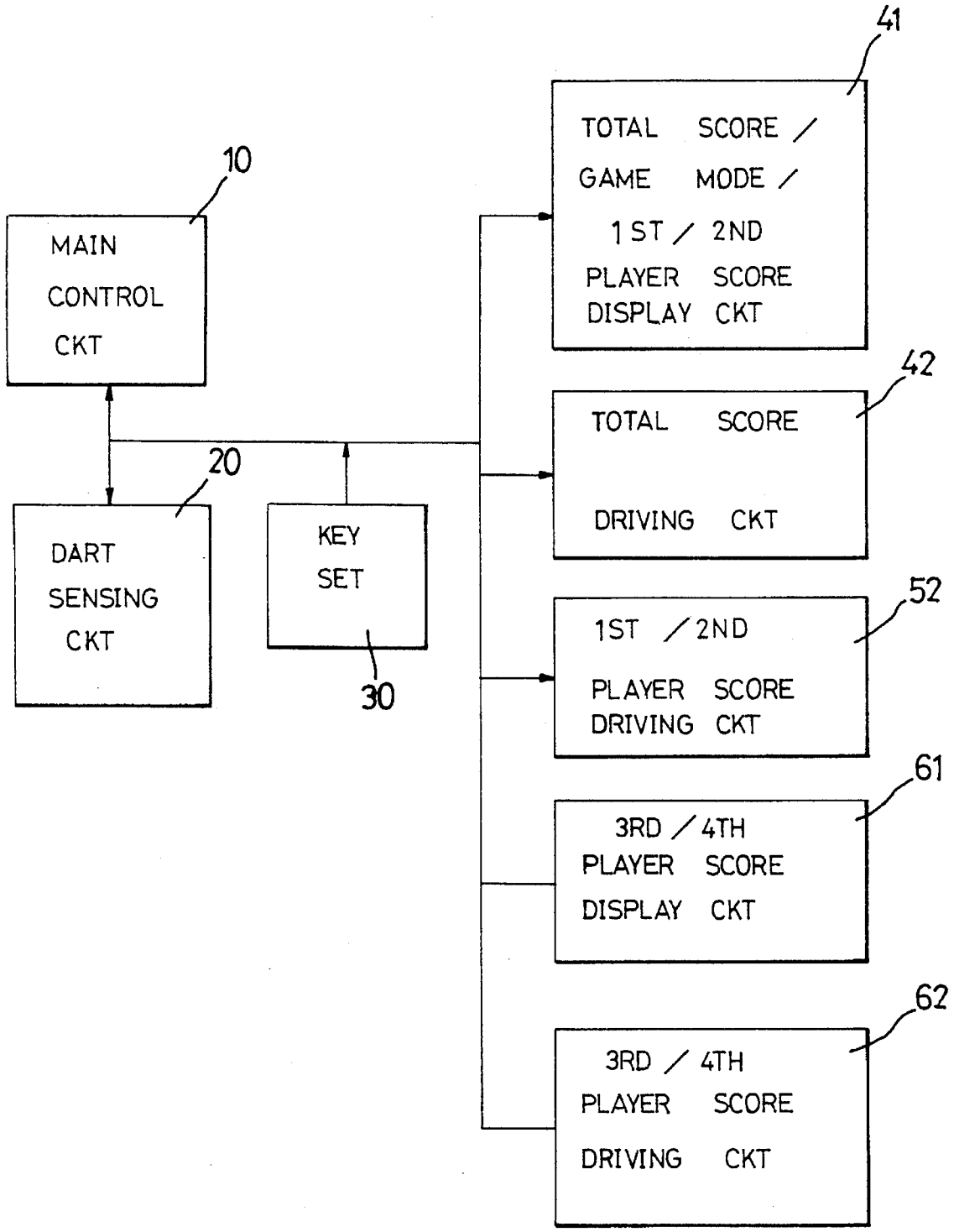
FIG. 2 is block diagram of an automatic counting apparatus for a dart game of the present invention.
Figure 3:
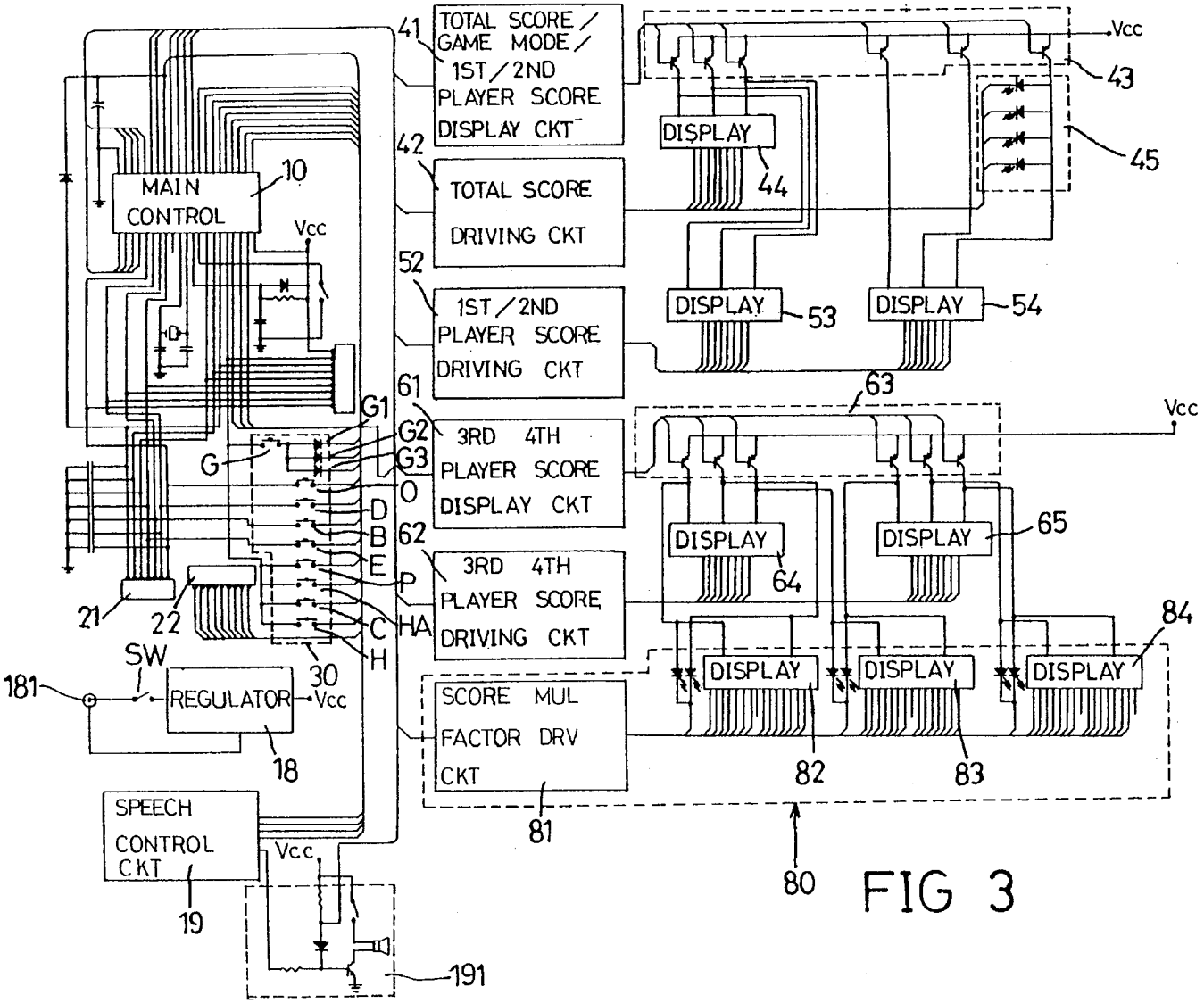
FIG. 3 is a circuit diagram of an automatic counting apparatus of the present invention.
Figure 4:
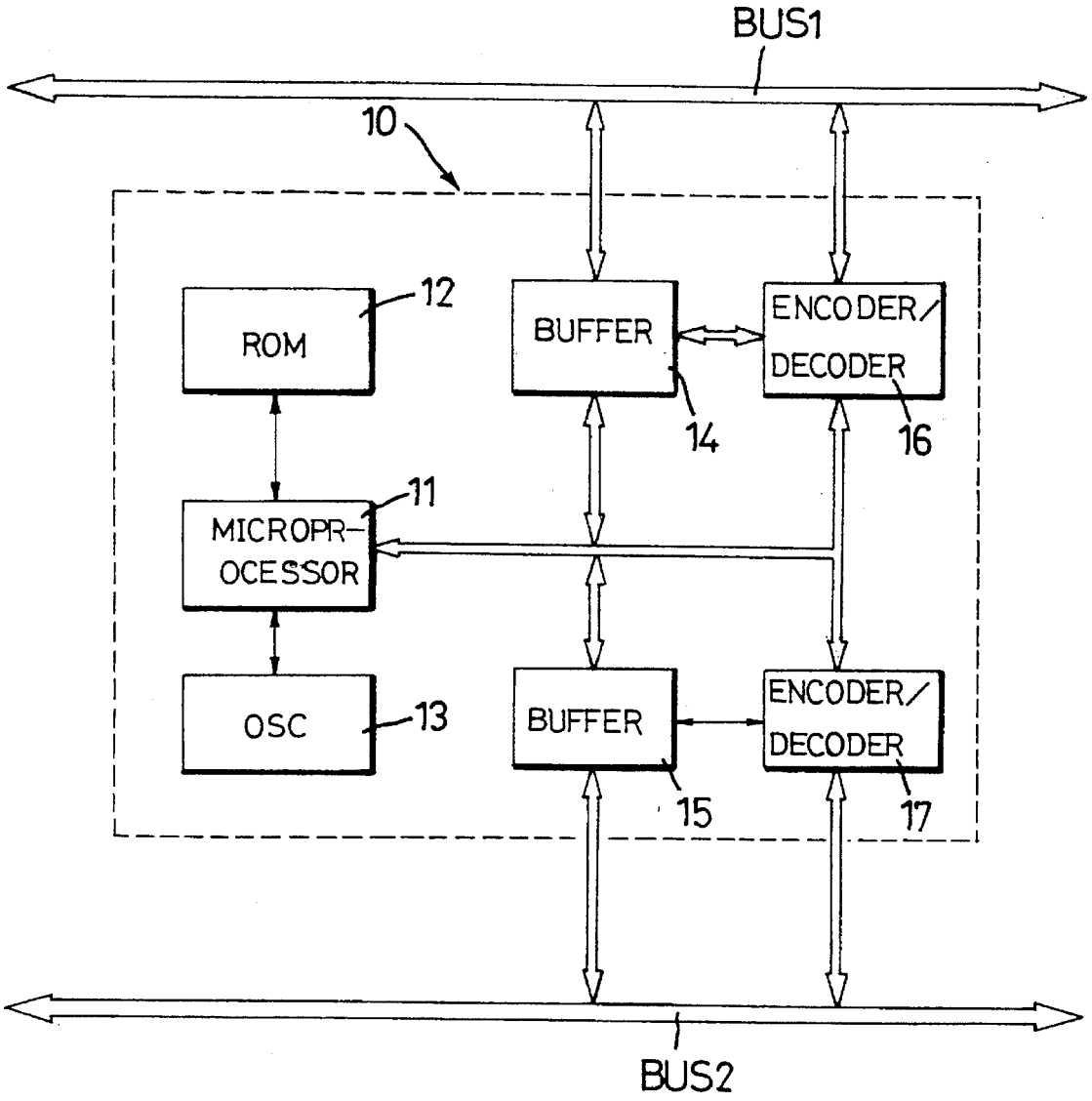
FIG. 4 is a block diagram of a main control circuit of the present invention.

The automatic counting apparatus for a dart game in accordance with the present invention is shown in FIGS. 2 and 3, where FIG. 2 illustrates a general system block diagram and FIG. 3 illustrates a detailed circuit thereof. Referring to FIG. 2, the automatic counting apparatus of the present invention comprises a main control circuit 10, a conventional dart sensing circuit 20, a key set 30, a total score/game mode displaying and first/second player score display circuit 41, a total score driving circuit 42 for driving the displaying circuit 41, a first/second player score driving circuit 52, a third/fourth player score display circuit 61, a third/fourth player score driving circuit 62. Referring to FIG. 4, the main control circuit 10 comprises a microprocessor 11, a read-only memory 12, an oscillator 13, two data buffers 14 and 15, two encoder/decoder circuits 16 and 17. The read-only memory 12 stores a firmware therein for controlling the operation of the microprocessor 11. The main control circuit 10 communicates with external components via two buses BUS1 and BUS2.

Referring to FIG. 3, two connectors 21 and 22 are used to connect the two buses BUS1 and BUS2 to the dart sensing circuit (not shown in this figure) for detecting the practical position to which the dart is thrown. The main control circuit 10 is further connected to the key set 30, the total score/game mode/first/second player score display circuit 41, the total score driving circuit 42, the first/second player score driving circuit 52, the third/fourth player score display circuit 61, and the third/fourth player score driving circuit 62 via the connectors 21 and 22. A power socket 181 for connecting to a direct current power source (not shown) is connected to a regulator 18 via a switch SW, thus a regulated voltage VCC is outputted from the regulator 18 as a source voltage for the counting apparatus. A speech circuit comprises a speech control circuit 19 and a speaker 191 for emitting an auxiliary speech such as the player sequence and the scoring to aid the process of the game with sound. A first driving transistor set 43 including a plurality of transistors is used for connection between the total score/game mode/first and second player score display circuit 41, the total score display 44, the game mode display 45, the first display 53, and the second display 54. The total score driving circuit 42 is connected to the total score display 44 for driving the latter. The first/second player score driving circuit 52 is connected to the first display 53 and the second display 54 for driving the displays 53 and 54. With this configuration, the total score display 44 can display a total score, the game mode display 45 can display a game mode of this dart game, the first display 53 can indicate the score of a first player, and the second display 54 can indicate a score of a second player.

A second driving transistor set 63 including a plurality of transistors is used for connection between the third display 64, the fourth display 65, and the three multiplication factor displays 82, 83, and 84. The third/fourth player score driving circuit 62 is connected to the third display 64 and the fourth display 65. A score multiplication factor driving circuit 81 is connected to the three score multiplication displays 82, 83, and 84 for driving the three displays 82, 83, and 84. With this configuration, the third display 64 can indicate the score of a third player, the fourth display 65 can indicate a score of a fourth player, one of the three multiplication factor displays 82, 83, and 84 will emit light when a dart hits on a specific multiplication area on the dart board 90.

Therefore, the configuration as mentioned above allows the players to operate the key set 30 thus setting a specific game mode via the main control circuit 10. In operation, the players first turn on the switch SW, therefore the regulator 18 can generate a DC voltage Vcc to supply to the counting apparatus. Next, the players set a game mode by operating the game mode setting key G, and set the number of players by operating the player setting key P, in the mean time the first display 53, the second display 54, the third display 64, and the fourth display 65 are lit one by one to show that each player has a corresponding display for illustrating his/her score. It should be noted that only one of the displays 53, 54, 64, and 65 is lit at one time. Next, the players set an object score for each player by operating the player setting key P and the option key O. If there is need for setting handicap, the players can operate the player setting key P to turn on the specific display and then operate the handicap key HA to decrease the object score shown on the specific display thus applying handicap on a player corresponding to the specific display. Next, the players can start to play a game of darts. When playing, the first display 53 will be lit to indicate the score of the first player in response to the scoring of his first throw, then the first display is automatically turned off and the second display 54 is lit to indicate the score of the second player in response to the scoring of the second player, and so on. In other words, the displays 53, 54, 64, and 65 will be lit sequentially to illustrate the scoring of the present playing player. The game mode, the number of the players, and the object score for each player is determined and not changeable after the dart thrown by the first player in the first throw hit the dart board 90. The displays 53, 54, 64, 65 are each sequentially and circularly lit up to indicate the score of the presently playing player.

Referring to FIG. 3, three diodes G1, G2, and G3 are connected between the game mode setting key G and the main control circuit 10. The number of game modes can be reduced by removing one or two of the diodes rather than changing the firmware of the system. For example, the number of the game modes can be reduced from eight to four by removing the diode G3, or from eight to two by removing the diodes G2 and G3.

I claim:

1. An automatic counting apparatus for a dart game which includes a set of darts and a dart board, comprising a main control circuit (10), a conventional dart sensing circuit (20) connected to the main control circuit (10) for sensing a dart impacting onto the dart board and transmitting corresponding thrown information to the main control circuit (10), a key set (30) including at least a first key (G), a second key (P), a third key (O), and a fourth key (HA) being connected to the main control circuit (10) for setting a plurality of inputs to the main control circuit (10), a plurality of displays for displaying the inputs already set by the key set (30), the improvement comprising:

the main control circuit (10) comprising a preprogrammed microprocessor (11), a read-only memory (12) for storing a firmware, an oscillator (13) connected to the microprocessor (11), two data buffers (14 and 15) and two encoder/decoder circuits (16 and 17) connected to the microprocessor (11) for communicating with the dart sensing circuit (20), the key set (30) and the displays via two buses (BUS1 and BUS2);

the inputs from the key set (30) includes:

a first input for determining a game mode from a plurality of available game modes by a manual operation on the first key (G);

a second input for determining a total number of players from a plurality of available total numbers of players according to a manual operation on the second key (P) of the key set (30);

a third input for determining a common object score for all the players according to a manual operation on the third key (O) of the key set (30); and a fourth input for adding a handicap on any one of the players by a manual operation on the fourth key (HA) thus causing the object score of the specific player to change from that originally set in the third input.

2. An automatic counting apparatus as claimed in claim 1, wherein the first key (G) is connected to the main control circuit (10) via a plurality of diodes (G1, G2, G3).

* * * * *